US006002891A

United States Patent [19]

Shin

[11] Patent Number: 6,002,891

[45] Date of Patent: Dec. 14, 1999

[54] PAPER PRESSING FORCE CONTROLLER FOR A PRINTER

[75] Inventor: Seong-soo Shin, Yongin, Rep. of Korea

[73] Assignee: Samsung Electronics Co., Ltd., Kyungki-do, Rep. of Korea

[21] Appl. No.: 09/115,512

[22] Filed: Jul. 15, 1998

[30] Foreign Application Priority Data

Jul. 30, 1997 [KR] Rep. of Korea ..... 97-36176

[51] Int. Cl.[6] ..... G03G 15/00; G03G 15/16; G03G 15/14

[52] U.S. Cl. ..... 399/45; 399/308; 399/318; 399/389

[58] Field of Search ..... 399/389, 45, 302, 399/318, 313, 308, 66

[56] References Cited

U.S. PATENT DOCUMENTS 5,835,832 11/1998 Rimai et al. ..... 399/308

FOREIGN PATENT DOCUMENTS 58-23052 2/1983 Japan .
5-246562 9/1993 Japan .
6-19341 1/1994 Japan .
254907 10/1996 Japan ..... G03G 15/16
034281 2/1997 Japan ..... G03G 15/16

*Primary Examiner*—Richard Moses
*Assistant Examiner*—Shival Virmani
*Attorney, Agent, or Firm*—Sughrue, Mion, Zinn, Macpeak & Seas, PLLC

[57] ABSTRACT

A paper pressing force controller of a printer includes a pressing roller that contacts a transfer roller for receiving a paper sheet therebetween. Guide rollers supply the paper sheet between the transfer roller and the pressing roller and a pressure sensing unit senses the pressure variations according to the thickness variations of the paper sheet supplied between the guide rollers. A pressure changing unit controls a pressing force of the pressing roller against the paper sheet by moving the pressing roller vertically with respect to the transfer roller.

4 Claims, 4 Drawing Sheets

| LOOK-UP TABLE | |
|---|---|
| THICKNESS | DISPLACEMENT |
| $T_1$ | $D_1$ |
| $T_2$ | $D_2$ |
| ⋮ | ⋮ |

PAPER PRESSING FORCE CONTROLLER FOR A PRINTER

BACKGROUND OF THE INVENTION

1. Field of the Invention

The present invention relates to a printer, and more particularly, to a paper pressing force controller of a printer, in which a gap between a transfer roller and a pressing roller can be controlled according to the thickness of a paper sheet.

2. Description of the Related Art

In general, a laser printer prints an image by developing a latent image formed on a photosensitive belt and transferring the developed image to a paper sheet.

FIG. 1 shows a conventional laser printer 10. Referring to FIG. 1, a photosensitive belt 12 is supported by rollers 11*a*, 11*b* and 11*c* and circulates around the rollers 11*a*, 11*b* and 11*c*. An electrostatic latent image is formed on the photosensitive belt 12 by laser scanning units 13, and is developed by developing devices 14. The laser scanning units 13 scan the photosensitive belt 12 with a light beam according to an image to be printed, and the developing devices 14 supply the photosensitive belt 12 with respective developers. In the case of a color printer, the color printer may be provided with a plurality of developing devices 14 and laser scanning units 13 corresponding to the respective colors, i.e., yellow (Y), magenta (M), cyan (C) and black (B).

The developed image on the photosensitive belt 12 is transferred to a transfer roller 15, and the transferred image is printed on a paper sheet 17, supplied from guide rollers 16, between the transfer roller 15 and a pressing roller 18.

The pressing roller 18 is elastically biased against the transfer roller 15 at a constant pressure by a spring 19*a* fixed to a supporter 19*b*. Therefore, constant pressure is exerted on the paper sheet 17 supplied between the transfer roller 15 and the pressing roller 18.

Thus, in a conventional printer, the pressing roller 18 is pressed at a constant pressing force by the spring 19*a* without reference to the thickness of a supplied paper sheet. Therefore, when a paper sheet 17 is thick, the constant pressure of the pressing roller 18 is transferred to the photosensitive belt 12 via the transfer roller 15, and the developed image may become distorted.

SUMMARY OF THE INVENTION

To solve the above problem, an object of the present invention is to provide a paper pressing force controller for a printer, in which a pressing force against a paper sheet supplied between a transfer roller and a pressing roller can be varied depending on the thickness of the paper sheet.

Accordingly, to achieve the above objective, a paper pressing force controller for a printer is provided, which comprises a pressing roller installed to contact a transfer roller which is supplied with a paper sheet therebetween; guide rollers for supplying the paper sheet between the transfer roller and the pressing roller; a pressure sensing unit for sensing the pressure variations according to the thickness variations of the paper sheet supplied between the guide rollers; and a pressure changing unit for controlling a pressing force of the pressing roller against a paper sheet by moving the pressing roller vertically with respect to the transfer roller.

The pressure changing unit comprises: a first guide for guiding the pressing roller which moves vertically with respect to the transfer roller; a moving member connected to the pressing roller by a support spring; a driving unit for moving the moving member vertically in order to make the pressing roller move vertically with respect to the transfer roller; and a second guide for guiding the moving member which moves vertically.

The driving unit comprises: a slider for moving the moving member vertically while horizontally moving in contact with the moving member; a guiding supporter for guiding the slider; a cam for moving the slider horizontally while rotating in contact with the slider; and a spring for biasing the slider toward the cam.

The slider has a slanted lower surface that contacts the moving member, and the moving member moves vertically as the slider moves horizontally.

BRIEF DESCRIPTION OF THE DRAWINGS

The above objective and advantage of the present invention will become more apparent by describing in detail a preferred embodiment thereof with reference to the attached drawings in which.

DESCRIPTION OF THE PREFERRED EMBODIMENT

Figure 1:
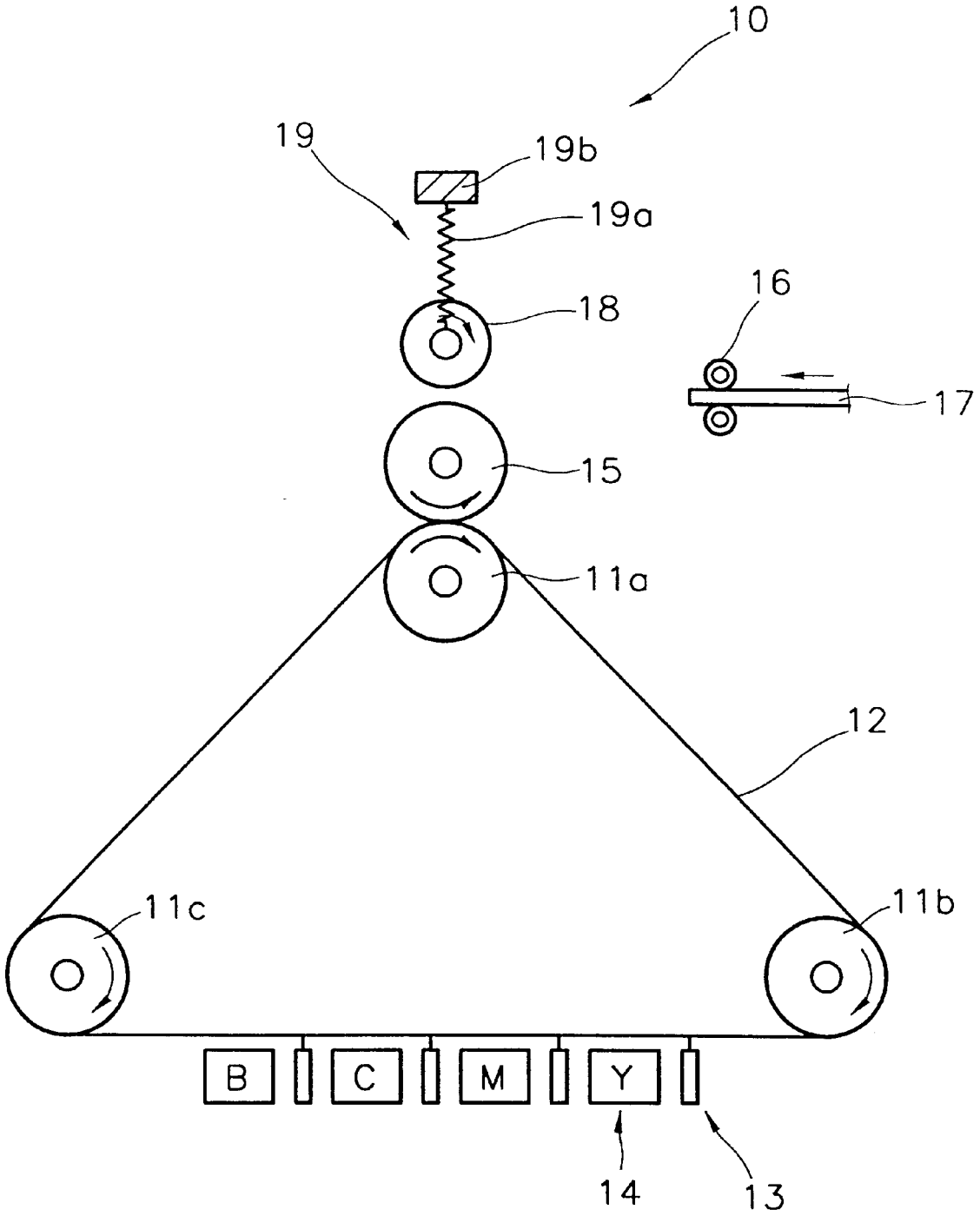
FIG. 1 (PRIOR ART)
FIG. 1 is a schematic diagram illustrating the structure of a conventional printer.
Figure 2:
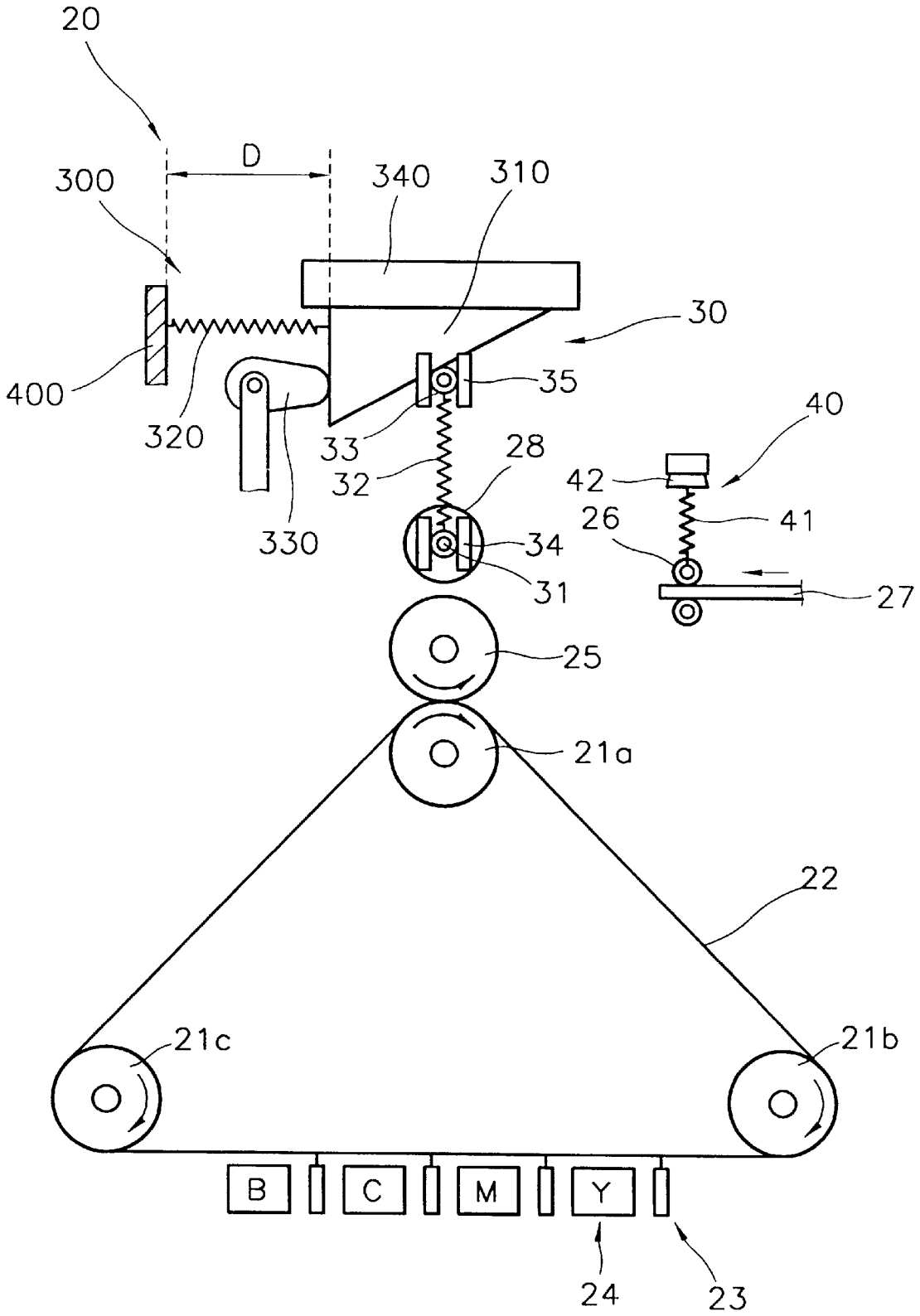
FIG. 2 is a schematic diagram illustrating the structure of a printer employing a paper pressing force controller according to the present invention.
Figure 3:
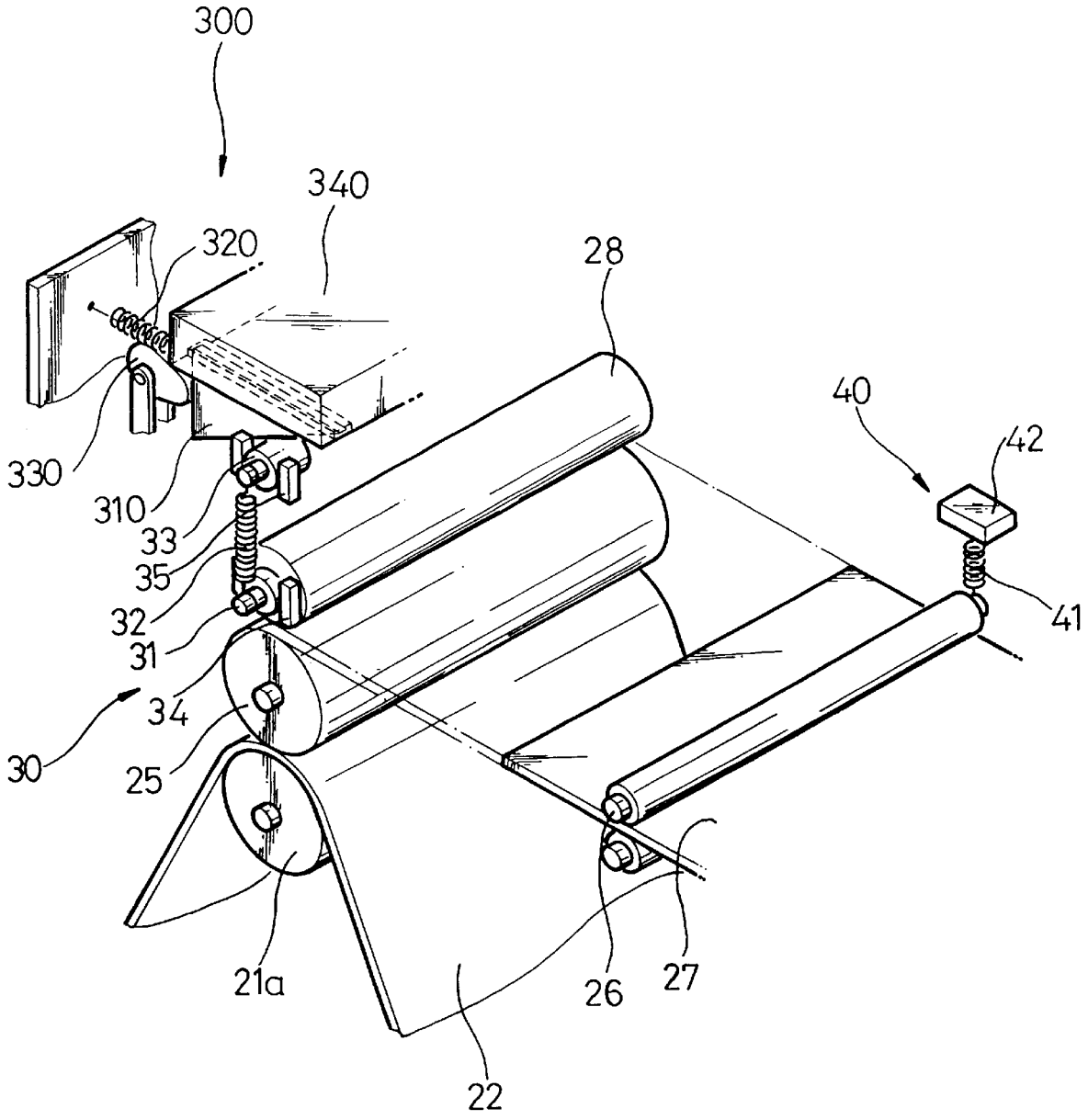
FIG. 3 is a perspective view illustrating a portion of FIG. 2.

FIGS. 2 and 3 show a printer 20 having a paper pressing force controller of a pressing roller according to the present invention. As shown in FIG. 2, a photosensitive belt 22 is supported by rollers 21*a*, 21*b* and 21*c* and circulates around the rollers 21*a*, 21*b* and 21*c*. Laser scanning units 23 and developing devices 24 are installed along the circulating path of the photosensitive belt 22. The laser scanning units 23 scan the photosensitive belt 22 with a light beam to form an electrostatic latent image on the photosensitive belt 22 and the developing devices 24 supply the photosensitive belt 22 with respective yellow (Y), magenta (M), cyan (C) and black (B) developers spaced apart from each other along the circulating path of the photosensitive belt 22.

As a transfer roller 25 rotates in contact with the surface of the photosensitive belt 22, the transfer roller 25 transfers the developed image formed with toners to a paper sheet 27. The paper sheet 27 is supplied from a pair of guide rollers 26 to the transfer roller 25 and a pressing roller 28.

A paper pressing force controller according to the present invention includes a pressure changing unit 30 connected to the pressing roller 28, and a pressure sensing unit 40 connected to the guide roller 26.

The pressure changing unit 30 moves the pressing roller 28 vertically, i.e., toward or away from the transfer roller 25 to control the force by which a paper sheet supplied between the transfer roller 25 and the pressing roller 28 is pressed.

The pressure changing unit 30 includes a first guide 34 for guiding the rotating shaft 31 of the pressing roller 28 so that the pressing roller 28 can move vertically with respect to the transfer roller 25. A moving member 33 which is connected to the pressing roller 28 by a support spring 32, moves a very short distance vertically with respect to the pressing roller 28 by being guided by a second guide 35. A driving unit 300 moves the moving member 33 vertically. The support spring 32 serves to maintain the distance between the pressing roller 28 and the moving member 33 and performs a buffering function.

The driving unit 300 includes a slider 310 that moves the moving member 33 vertically by moving horizontally while contacting the moving member 33. A guiding supporter 340 guides the slider 310 and a cam 330 moves the slider 310 horizontally by rotating in contact with the slider 310. A spring 320 is connected to the slider 310 and a supporter 400 for biasing the slider 310 toward the cam 330. The slider 310 has a slanted lower surface that contacts the moving member 33, so that the moving member 33 moves vertically as the slider 310 moves horizontally.

In addition, the pressure sensing unit 40 is installed at one of the guide rollers 26 for sensing the pressure variations according to the thickness variations of a paper sheet 27 supplied between the guide rollers 26. The pressure sensing unit 40 comprises a spring 41, having one end connected to the rotating shaft of one guide roller 26, and a sensor 42 connected to the other end of the spring 41 for sensing the pressure variations according to the thickness variations of a paper sheet 27. Further, the pressure changing unit 30 and the pressure sensing unit 40 are connected to a controller (not shown).

Referring to FIGS. 2 and 3, as the pressing roller 28 moves vertically with respect to the transfer roller 25 according to the thickness of the paper sheet 27, the pressing force of the pressing roller 28 against the paper sheet 27 can be appropriately controlled.

When the paper sheet 27 is not supplied, and the pressing force sensed by the sensor 42 is $P_1$, if the paper sheet 27 is then supplied between the guide rollers 26, the spring 41 is compressed, and the pressing force against the paper sheet 27 is increased to $P_2$. The pressure variations that are caused by the displacement of the spring 41 are sensed by the sensor 42, and a signal corresponding to the pressure difference $P_2-P_1$ is input to the controller (not shown).

The controller drives the cam 330 according to the input signal, which moves the slider 310. At this time, the displacement of the slider 310 is expressed by the distance between the slider 310 and the supporter 400 with the following formula:

Displacement of Slider–Distance before Slider Movement $D_1$–Distance after Slider Movement $D_2$ $$\text{Displacement of Slider} = \text{Distance before Slider Movement } D_1 - \text{Distance after Slider Movement } D_2 = \frac{P_2 - P_1}{k \times f}$$

in which, $P_1$ is the pressure of the guide rollers before a paper sheet is supplied, $P_2$ is the pressure of the guide rollers after a paper sheet is supplied, k is the spring constant, and f is a conversion constant of the moving member 33. The conversion constant of the moving member 33 is the ratio of the vertical displacement of the moving member 33 to the horizontal displacement of the slider 310.

In addition, the controller measures the time required for the paper sheet 27 to move from the guide roller 26 to the position between the transfer roller 25 and the pressing roller 28, and precisely controls when the paper sheet 27 is entered between the transfer roller 25 and the pressing roller 28, and when the eccentric cam 330 is driven, according to this measured time.

When the eccentric cam 330 rotates, the slider 310 that contacts the eccentric cam 330 moves horizontally along the guiding supporter 340. Accordingly, the moving member 33 which contacts the slanted surface of the slider 310 moves vertically along the second guide 35 to change the pressing force of the pressing roller 28.

When the paper sheet 27 has passed through the guide rollers 26, the pressing force is changed from $P_2$ to $P_1$. The changed pressure value is sensed by the sensor 42 and is input to the controller. Then, the controller rotates the eccentric cam 330, and the slider 310 is returned to its original position by the restoring force of the spring 320.

Figures 4, 5:
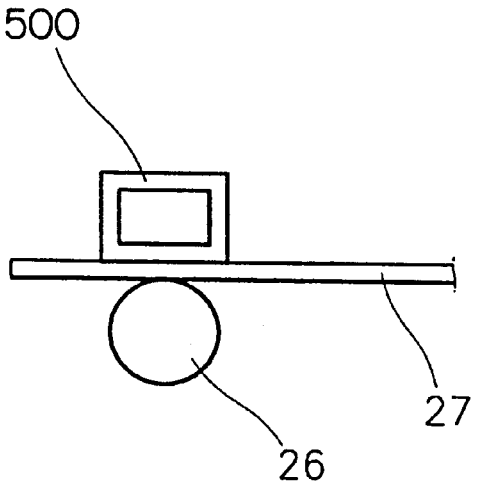
FIG. 4 is a sectional view illustrating a guide roller and a thickness sensor of another embodiment according to the present invention.
FIG. 5 is a look-up table employed in the embodiment of FIG. 4.

FIG. 4 shows another example of a sensor for sensing the thickness of a paper sheet. A sensor 500 contacts a guide roller 26, measures the thickness of a paper sheet supplied between the sensor 500 and the guide roller 26, and sends a signal indicative of the thickness to the controller. The controller sends a displacement value to the pressure changing unit 30 (see FIG. 3), corresponding to the thickness of the paper sheet 27 based on a look-up table shown in FIG. 5 according to the input signal. Therefore, the pressing roller 26 presses the paper sheet 27 with an appropriate force.

In the present invention described above, since the pressing force against a paper sheet is controlled by controlling the position of the pressing roller, and therefore the transfer roller and the photosensitive belt can be smoothly operated, the quality of printing can be enhanced.

Although the invention has been described with reference to the accompanying drawings for the purposes of illustration, it should be understood that various modifications and equivalents may be made by those skilled in the art without departing from the spirit and scope of the invention.

What is claimed is:

1. A paper pressing force controller for a printer comprising:

a pressing roller contacting a transfer roller;

guide rollers for supplying a paper sheet between the transfer roller and the pressing roller;

a pressure sensing unit for sensing pressure variations according to a thickness of the paper sheet supplied between the guide rollers; and a pressure changing unit for controlling a pressing force of the pressing roller against the paper sheet by moving the pressing roller vertically with respect to the transfer roller, wherein the pressure changing unit controls the pressing force of the pressing roller according to the pressure variation sensed by the pressure sensing unit, wherein the pressure changing unit comprises a first guide for guiding the pressing roller which moves vertically with respect to the transfer roller, a moving member connected to the pressing roller by a supporting spring, a driving unit for moving the moving member vertically in order to make the pressing roller move vertically with respect to the transfer roller, and a second guide for guiding the moving member which moves vertically.

2. The paper pressing force controller as claimed in claim 1, wherein the driving unit comprises:

a slider for moving the moving member vertically while horizontally moving in contact with the moving member;

a guiding supporter for guiding the slider;

a cam for moving the slider horizontally while rotating in contact with the slider; and a spring attached to a support and the slider for biasing the slider toward the cam.

3. The paper pressing force controller as claimed in claim 2, wherein the slider has a slanted lower surface which contacts the moving member, so that the moving member moves vertically as the slider moves horizontally.

4. The paper pressing force controller as claimed in claim 1, wherein the pressure sensing unit comprises:

a spring having one end connected to one of the guide rollers; and a sensor connected to the other end of the spring for sensing the pressure variations according to elastic deformations of the spring.

* * * * *